US005531427A

United States Patent [19]

Quarles

[11] Patent Number: 5,531,427

[45] Date of Patent: Jul. 2, 1996

[54] METALLIC FENCE SYSTEM

[76] Inventor: Dwight R. Quarles, 2100 Evergreen, Garland, Tex. 75041

[21] Appl. No.: 202,527

[22] Filed: Feb. 28, 1994

[51] Int. Cl.[6] ..... E04H 17/16

[52] U.S. Cl. ..... 256/22; 256/24; 256/DIG. 2

[58] Field of Search ..... 256/21, 22, 65, 256/59, 69, 68, 24, 34, 1, 73, DIG. 5, DIG. 2

[56] References Cited

U.S. PATENT DOCUMENTS

| | | | |
|---|---|---|---|
| 43,644 | 7/1864 | Miller | 256/22 |
| 950,832 | 3/1910 | Banning | 256/22 X |
| 2,295,271 | 9/1942 | Schuck | 256/24 |
| 2,607,563 | 8/1952 | Rochester | 256/22 |
| 2,773,674 | 12/1956 | Fischer et al. | 256/22 |
| 2,919,113 | 12/1959 | Cofield | 256/22 X |
| 3,315,943 | 4/1967 | Van Den Brock | 256/22 |
| 3,342,458 | 9/1967 | Simonton | 256/24 |
| 3,383,819 | 5/1968 | Zimmer et al. | 256/24 X |
| 3,822,053 | 7/1974 | Daily | 256/22 |
| 3,960,367 | 6/1976 | Rogers | 256/21 |
| 4,369,953 | 1/1983 | Greiner et al. | 256/65 X |
| 4,625,948 | 12/1986 | Lustvee | 256/22 X |
| 4,723,760 | 2/1988 | O'Sullivan | 256/22 |
| 5,150,885 | 9/1992 | Leone | 256/22 |
| 5,443,244 | 8/1955 | Gibbs | 256/22 |

FOREIGN PATENT DOCUMENTS

| | | | |
|---|---|---|---|
| 104675 | 7/1899 | Germany | 256/22 |

*Primary Examiner*—Kenneth J. Dorner
*Assistant Examiner*—Harry C. Kim
*Attorney, Agent, or Firm*—Harris, Tucker & Hardin

[57] ABSTRACT

A metallic fence system (10) provides an easily constructed, durable and adaptable system using metal posts (12), cross-pieces (14) between the posts and pickets (20, 30, 40, 50, 60, 70) attached to the cross-pieces (14). Each picket can be either fixed in width (20, 30, 40) or adjustable in width (50, 60, 70). The adjustable pickets can be varied in width to suit a particular need. The pickets can be standard pickets (20, 50) or can be pickets (30, 40, 60, 70) with offset portions. Pickets with offset portions can be placed adjacent to each other and the offset portions will overlap to provide a seamless fence.

32 Claims, 1 Drawing Sheet

METALLIC FENCE SYSTEM

TECHNICAL FIELD OF THE INVENTION

The present invention relates to a metallic fence system formed with metal posts, cross-pieces, pickets, and caps. The system can produce a durable privacy fence in a variety of styles and lengths.

BACKGROUND OF THE INVENTION

Fences enhance the value of a house or other structure by providing a level of privacy and security for its owners. Fences are constructed in a variety of styles and lengths and from a variety of materials. A simple "hurricane fence" is little more than a mesh of wire attached between several spaced posts. It provides virtually no privacy, but is effective in keeping animals and others either inside or outside of the fence.

Wood is another popular material for the construction of fences. Pine and cedar are particularly popular for residential use. A "picket fence" utilizes a series of spaced, vertical posts partially sunk into the soil. The posts can be ballasted with concrete. At least one horizontal cross-piece is then attached between two adjacent posts. Pickets are then vertically attached to the cross-pieces. The pickets can be spaced, placed immediately adjacent to each other, or placed "board-on-board." When the pickets are spaced, privacy is compromised, yet less material is needed. When pickets are placed immediately adjacent to each other, a higher level of privacy is achieved. However, over time, the wood pickets will shrink, creating increasingly larger seams between the pickets, and a loss of privacy. When the pickets are placed "board-on-board," each picket overlaps its adjacent picket. Thus, even when the wood pickets shrink with age, no seams occur between the pickets, and privacy is maintained.

Wood pickets come in a standard width. However, at the end of the fence, a unique width of picket may be needed to finish. For example, a forty foot fence would require 120 four inch pickets laid immediately adjacent to each other. If the fence is forty feet and one inch in length, a one inch space is left. Thus, a nonstandard picket can be fashioned at great cost, a standard picket can be split, or the space left open. None of these options are satisfying. In a board-on-board fence, this problem can be addressed by a skilled carpenter by varying the amount of overlap. Still, this skill is beyond many casual laborers.

The cost of a wood fence is based on several factors. The actual wood involves a sizable expenditure. Due to environmental regulations protecting owls and the like, large portions of forests in this country can no longer be harvested. Coupled with this diminishment of supply, demand for the remaining wood supply has been heightened by the rebuilding efforts occasioned by natural disasters, such as hurricanes and the like. As such, genuine shortages periodically exist making the costs of quality wood fencing out of reach for many. Moreover, once constructed, it is difficult to deconstruct a fence to salvage any of the pickets or cross-pieces used.

The cost of a wood fence also includes the cost of maintenance from deterioration. Most wood fences have a pleasing appearance when first constructed. Unless properly treated, rain, insects, and extreme temperatures will discolor and weaken the wood. After a meager few passing of seasons, the wood appears gray. A commercial treatment can be applied to restore the original color or stain the wood a different color. Other treatments deter termites and molds from attacking the fence. Still others can make the wood water resistant. Of course, such treatments only add to the overall cost of the fence on a periodic basis. A wood fence is also susceptible to loss from fire and vandalism. Wood has a lower shear strength than most metals and can splintered with a strong kick by a passing angry teenager. Wood also burns. Its flammability can even be increased by the commercial treatments mentioned above.

A need exists for a fence which combines the durability of a hurricane metal fence with the beauty and privacy afforded by a wood fence. Such a fence must be durable enough to withstand the abuse of weather, wind, and insects. Yet despite this durability, the fence should cost less to produce and construct than a wood fence. It should be only require the use of standard hardware and fasteners to build. Also, it should enable the builder to use adjustable width pickets to handle awkward situations. The new fence system should help conserve our natural lumber resources, by avoiding the use of wood. Most importantly, the new fence system should produce a beautiful fence of any style without needing constant refurbishing.

SUMMARY OF THE INVENTION

The present invention relates to a metallic fence system. The system uses preformed pickets constructed of metal sheeting broken into different pieces to simulate the lumber used in traditional fencing. Metal posts are vertically anchored to the ground. At least one metal cross-piece is horizontally attached between adjacent posts. Each cross-piece can have a plurality of spaced, pre-drilled holes along its span. Pickets are next attached to the cross-pieces. Each picket can have at least one pre-drilled hole therethrough which corresponds to a hole in a cross-piece. When these holes are aligned, a sheetmetal screw or other suitable fastener can be passed through the holes, fastening the pieces together. Alternatively, if the pickets and cross-pieces do not have pre-drilled holes, a self-tapping screw can be used to attach the pieces. Standard hardware is used to attach the cross-pieces to the posts.

The pickets can be made of aluminum, steel or other suitable metal with a smooth or woodgrain texture. The pickets can be colored to match the tone of various woods. Thus, the pickets presents the beauty of natural wood, yet is virtually permanent, fireproof, and can be made from recycled material. Fencing constructed of aluminum or steel also conserves the world's natural lumber supply. If desired, the fencing system can be deconstructed and recycled when it is no longer needed.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
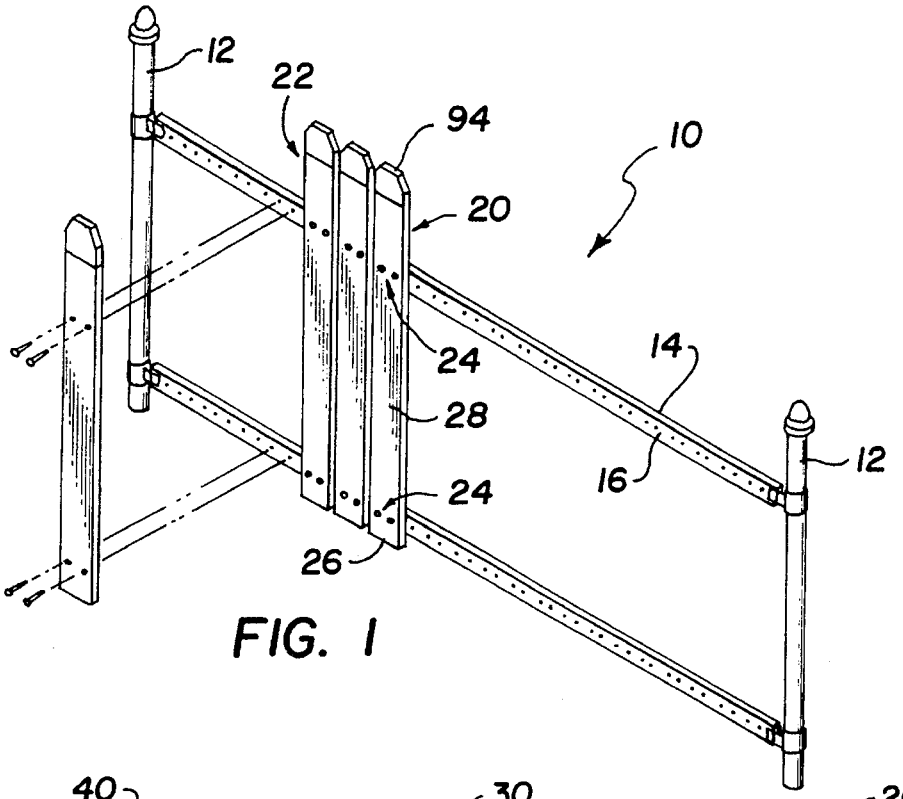
FIG. 1 illustrates a partially constructed metallic fence system.

The present invention relates to a metallic fence system flexible enough to create virtually any length or shape of fence. The system does not deteriorate with age as does a normal wooden fence. On the contrary, the present fence can be formed from aluminum elements which resist the elements. FIG. 1 illustrates a fence system 10 which embodies the present invention. The system 10 includes the basic building blocks of a fence: posts 12, cross-pieces 14, and pickets 20. Each basic element is designed to be attached to the other elements by suitable fasteners.

Referring to FIG. 1, a partially constructed metallic fence 10 is formed between a pair of posts 12. Two cross-pieces 14 span the distance between the posts 12. Each end of cross-piece 14 is attached to the post using standard hardware 2. The span of each cross-piece 14 can include a series of spaced holes 16 suitable for accepting a fastener. A plurality of pickets 20 are attached to said cross-pieces. Each picket has an upper end 22, a lower end 26 and a central span 28. Each picket 20 has at least one pre-drilled hole 24 along its central span 28. Picket holes 24 and cross-piece holes 16 can be aligned and a sheetmetal screw or other suitable fastener inserted. For increased stability, two pair of holes 24 can be used to attach the picket to two cross-pieces. The pickets 20 can be manufactured from sheet metal such as aluminum broken into rectangular or offset configurations, as will be discussed below. Each picket can have a smooth or a woodgrain finish, and can be made in a variety of colors. In fact, using random coloration, a natural wood look could be achieved. The coloration could vary from a new wood look all the way to the look of weathered wood. Assembled 8-foot wide sections could be factory made to ease and speed installation. Gates can also be factory made and can use standard gate hardware.

Figure 2A:
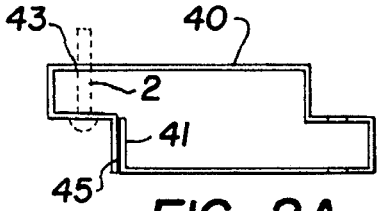
FIGS. 2*a*, 2*b*, and 2*c* provide sectional views of various fixed size picket designs.
Figure 2B:
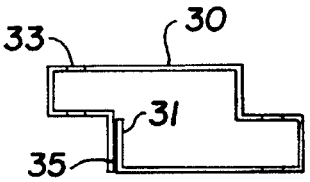
Figure 2C:
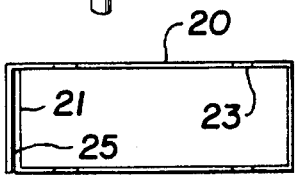

FIGS. 2*a*, 2*b*, and 2*c* provide sectional views of various fixed size picket designs 20, 30, 40. Picket 20 is generally rectangular in cross-section. Pickets 30, 40 provide offset portions which overlap with adjacent similar pickets. This offset, interlocking design provides total privacy while allowing for temperature-related expansion and contraction of each picket. In each style, overlapping metal sheeting on edge 21, 31, 41 helps to hide seems. The overlapping can be sealed by riveting, adhesives, and the like. Spot welds 25, 35, 45 are shown for illustration purposes. Each picket will be dimensioned to easily install into standard fence hardware. Picket 30 is slightly wider than picket 40. Pre-drilled holes 23, 33, 43 provide a path for accepting a fastener. It should be clearly understood that the pre-drilled holes are optional; a self-tapping screw can be used to attach the pickets to the cross-pieces. When formed, the pickets are hollow. However, in one embodiment, the fixed width picket can be filled with a polymer or other suitable material to help maintain the shape of the picket.

Figure 3A:
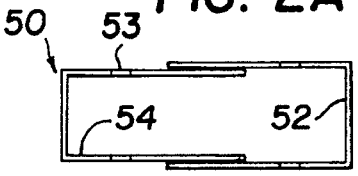
FIGS. 3*a*, 3*b*, and 3*c* provide sectional views of various adjustable pickets.
Figure 3B:
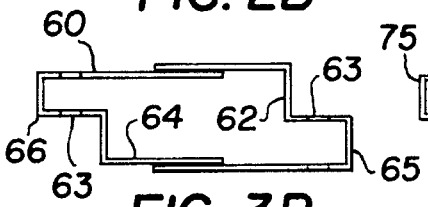
Figure 3C:
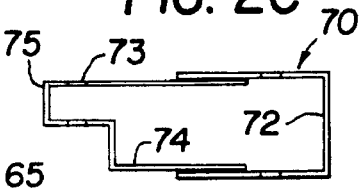

FIGS. 3*a*, 3*b*, and 3*c* provide sectional views of various adjustable pickets 50, 60, 70. The adjustable pickets are of two piece design and are used at the end of a fence or other places where a single fixed size picket will not fit properly. Picket 50 is formed by first portion 52 and second portion 54 which slidably interlock. Thus, the width of the picket can be increased or decreased as needed. Picket 50 is generally rectangular in shape and therefore best used to augment a fence formed with rectangular picket 20 (FIG. 2*c*). Picket 60 is formed by a first portion 62 and a second portion 64 which slidably interlock. Thus, the width of picket 60 can be increased and decreased as needed. Each portion 62, 64 includes offset portions 65 and 66 respectively. Each portion 62, 64 of picket 60 can have pre-drilled holes 63. Picket 60 generally matched the shape of pickets 30, 40 and can be used to augment a fence constructed with such pickets. Picket 70 is also constructed of a first and second portion 72, 74 which slidably interlock. Only one portion, such as second portion 74, can have an offset portion 75. Again, both portions can have pre-drilled holes 53, 63, and 73. Picket 70 could be used as an end picket in a fence formed with pickets 30, 40.

Figure 4A:
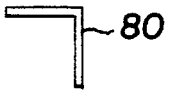
FIGS. 4*a* and 4*b* illustrate manufactured angles used as trim pieces for inside and outside corners.
Figure 4B:
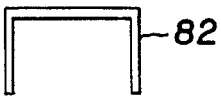
Figure 5A:
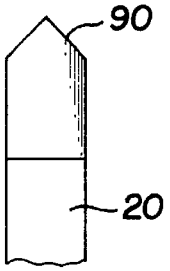
FIGS. 5*a*, 5*b*, 5*c* and 5*d* illustrate various shapes for caps placed on the top of any particular picket.
Figure 5B:
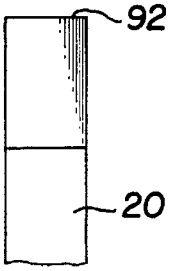
Figure 5C:
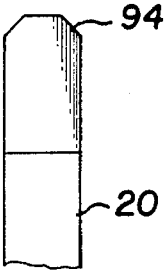
Figure 5D:
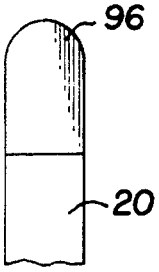

FIGS. 4*a* and 4*b* illustrate manufactured angles used as trim pieces for inside and outside corners. L-shaped piece 80 can be laid across an edge surface of a picket to create a more finished look. Likewise, C-channel 82 can be laid horizontally across the top of the pickets and provide a trimmed finished look for the top of the fence. Either trim piece 80, 82 eliminates the need for plugs or caps on the top of the pickets. Each trim piece can also be manufactured from aluminum sheeting.

FIGS. 5*a*, 5*b*, 5*c*, and 5*d* illustrate various caps for use on the top of any particular picket. When a picket is initially formed, its top end may be open to the elements. Water could accumulate within the picket. To alleviate this problem, as well as to add a decorative aspect to the picket, a cap can be placed over its top end. For example, a pointed cap 90 can improve the security provided by the fence 10. A burglar might move to another house before climbing over this picket. Flat cap 92 provides a flat appearance to the fence. Mitered cap 94 has a set of mitered corners, while curved cap 96 provides a curved look. Each cap can be made an integral part of the picket during the construction of the picket. Alternatively, the top end of each picket can be slightly crimped to accept a cap. In one embodiment, the cap is a force fit onto the picket. The cap can be attached to the picket by any suitable means.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. A fence system comprising:

(a) at least one metal post;

(b) at least one metal cross-piece attached to said post;

(c) at least one metal hollow picket attached to said cross-piece and having a top end, a front wall, a rear wall, wherein said front and rear walls are separated by side walls, wherein said picket has a width which is adjustable.

2. The fence system of claim 1 wherein said picket has a generally rectangular section.

3. The fence system of claim 2 wherein said picket further comprises at least one offset portion.

4. The fence system of claim 3 wherein said offset portion compliments an adjacent offset portion of an adjacent picket wherein said portions overlap.

5. The fence system of claim 1 wherein said picket provide at least one pre-drilled hole to accept a fastener means.

6. The fence system of claim 5 wherein said fastener means comprises a sheetmetal screw.

7. The fence system of claim 1 wherein said metal picket is made of aluminum.

8. The fence system of claim 1 wherein said metal picket is textured to simulate a wood grain.

9. The fence system of claim 1 wherein said metal picket is smooth.

10. The fence system of claim 1 wherein said adjustable picket comprises a first portion slidably engaged with a second portion.

11. The fence system of claim 1 further comprises at least one trim piece attached to said picket.

12. The fence system of claim 11 wherein said trim piece is a C-channel which can overlap an edge of the picket.

13. The fence system of claim 11 wherein said trim piece is an L-shaped piece which can overlap an edge of the picket.

14. The fence system of claim 1 further comprises:

(d) a cap attached to said at least one metal picket over the top end.

15. A fence system comprising a hollow metal picket said metal picket comprising:

(a) a front wall, (b) a rear wall, and (c) a pair of side walls between said front and rear walls, wherein said picket has a width which is adjustable.

16. The fence system of claim 15 further comprises:

(d) a cap attached to the said metal picket.

17. A privacy fence system comprising:

(a) at least one metal post;

(b) at least one metal cross-piece attached to said post; and (c) a plurality of hollow metal pickets attached to said cross-piece, each picket having a top end, a front wall, a rear wall, wherein said front and rear walls are separated by side walls, wherein each of said pickets further comprises at least one offset portion which compliments an adjacent offset portion of another of said plurality of pickets wherein said offset portions overlap thereby providing the privacy fence system with the plurality of pickets having a constant thickness which is substantially equal to the thickness of each of said pickets, and wherein said fence system is substantially impenetrable to wind.

18. The fence system of claim 17 wherein said picket has a generally rectangular section.

19. The fence system of claim 17 wherein said picket provide at least one pre-drilled hole to accept a fastener means.

20. The fence system of claim 19 wherein said fastener means comprises a sheetmetal screw.

21. The fence system of claim 17 wherein said metal picket is made of aluminum.

22. The fence system of claim 17 wherein said metal picket is textured to simulate a wood grain.

23. The fence system of claim 17 wherein said metal picket is smooth.

24. The fence system of claim 17 wherein said picket has a width which is fixed.

25. The fence system of claim 17 wherein said picket has a width which is adjustable thereby forming an adjustable picket.

26. The fence system of claim 25 wherein said adjustable picket comprises a first portion slidably engaged with a second portion.

27. The fence system of claim 17 further comprises at least one trim piece attached to said picket.

28. The fence system of claim 27 wherein said trim piece is a C-channel which can overlap an edge of the picket.

29. The fence system of claim 27 wherein said trim piece is an L-shaped piece which can overlap an edge of the picket.

30. A fence system comprising a plurality of hollow metal pickets, each of said metal pickets comprising:

(a) a front wall, (b) a rear wall, and (c) a pair of side walls between said front and rear wails, wherein each of said pickets further comprises at least one offset portion which compliments an adjacent offset portion of another of said plurality of pickets wherein said offset portions overlap thereby providing the fence system with the plurality of pickets having a constant thickness which is substantially equal to the thickness of each of said pickets, and wherein said fence system is substantially impenetrable to wind.

31. The fence system of claim 30 further comprises:

(d) a cap attached to said metal picket.

32. The fence system of claim 30 wherein said metal picket has a width which is adjustable.

* * * * *